US007421860B2

(12) United States Patent
Dias et al.

(10) Patent No.: US 7,421,860 B2
(45) Date of Patent: Sep. 9, 2008

(54) KNITTING MACHINES AND METHODS OF KNITTING

(75) Inventors: Tilak Dias, Stockport (GB); William Cooke, Cheshire (GB); Anura Fernando, Cheadle (GB)

(73) Assignee: The University of Manchester (GB)

( * ) Notice: Subject to any disclaimer, the term of this patent is extended or adjusted under 35 U.S.C. 154(b) by 15 days.

(21) Appl. No.: 10/567,184

(22) PCT Filed: Aug. 5, 2004

(86) PCT No.: PCT/GB2004/003381

§ 371 (c)(1),
(2), (4) Date: Aug. 21, 2006

(87) PCT Pub. No.: WO2005/014903

PCT Pub. Date: Feb. 17, 2005

(65) Prior Publication Data

US 2007/0180863 A1 Aug. 9, 2007

(30) Foreign Application Priority Data

Aug. 5, 2003 (GB) ..... 0318271.4

(51) Int. Cl.
*D04B 15/50* (2006.01)

(52) U.S. Cl. ..... 66/132 R

(58) Field of Classification Search ..... 66/13, 66/216–218, 62, 64, 147, 149 R, 152
See application file for complete search history.

(56) References Cited

U.S. PATENT DOCUMENTS

| | | | | |
|---|---|---|---|---|
| 3,327,499 | A | 6/1967 | Schmidt et al. | |
| 4,763,492 | A * | 8/1988 | Tibbals, Jr. | 66/232 |
| 4,829,790 | A * | 5/1989 | Memminger et al. | 66/132 R |
| 5,174,133 | A | 12/1992 | Kawase et al. | |
| 6,158,250 | A * | 12/2000 | Tibbals et al. | 66/62 |
| 6,301,938 | B1 * | 10/2001 | Takeuchi et al. | 66/54 |
| 6,321,576 | B1 * | 11/2001 | Barea | 66/132 R |

FOREIGN PATENT DOCUMENTS

DE 36 29 699 A 3/1988

* cited by examiner

*Primary Examiner*—Danny Worrell
(74) *Attorney, Agent, or Firm*—McDermott Will & Emery, LLP

(57) ABSTRACT

There is disclosed a knitting machine comprising: at least one knitting needle; at least one positive yarn feed device for feeding yarn to said at least one knitting needle; needle monitoring means for providing information relating to the at least one knitting needle during the course of a knitting operation; and a controller for controlling the operation of the positive yarn feed device; in which the controller is adapted to: receive information from the needle monitoring means during the course of a knitting operation; use said information to calculate a desired amount of yarn to be fed to a knitting needle; and control the positive yarn feed device so that the positive yarn feed device feeds the desired amount of yarn to the knitting needle during the course of the knitting operation.

27 Claims, 6 Drawing Sheets

KNITTING MACHINES AND METHODS OF KNITTING

This application claims priority from PCT Application No. PCT/GB2004/003381, filed Aug. 5, 2004 (incorporated by reference herein), and British Application No. 0318271.4, filed Aug. 5, 2003 (incorporated by reference herein).

This invention relates to improved knitting machines and methods of knitting.

The present invention is principally concerned with—but is not limited to—flat bed knitting machines. In order to explain fully certain disadvantages which are associated with prior art flat bed knitting machines, and to aid in the explanation of the advantageous features provided by the present invention, it is helpful to briefly review some of the salient features of prior art flat bed knitting machines.

Important aspects of prior art flat bed knitting machines include the needles employed, the needle bed, knitting cams, and yarn feeding devices.

Probably the most important form of knitting needle in the context of flat bed knitting is the latch needle. The latch needle has the advantage of being self acting or loop controlled. For this reason, it is the most widely used knitting needle in weft knitting and is sometimes termed the automatic needle. Precisely manufactured latch needles are today knitting fabrics of high quality at very high speeds.

FIG. 1 depicts a latch needle 10, which has the following important parts: a hook 12 which draws and retains the knitting loop; a latch 14; a rivet or axle 16 of the latch needle 10; a stem 18 which carries the knitted loop in the clearing or rest position; and a butt 20 which enables the movement of the needle 10 by utilising cams.

In order to form a new knitted loop the needle has to be reciprocated between two fixed points, ie, between two dead centres. During a forward movement of the needle the knitted loop, which was formed earlier, is cleared from the hook because the knitted loop slides down inside the hook and hits the latch; this will result in the opening of the needle hook (due to the anti-clockwise rotation of the latch). Further movement of the needle causes the knitted loop to slide off the latch and then down on to the stem. This is the final position of the forward movement of the needle, known in the knitting technology art as the clearing position or clearing height of a needle.

During the backward movement of the needle the hook is closed automatically because the knitted loop which was on the stem slides forwards, contacting and pivoting the latch tightly closed. Before this occurs a new yarn has to be laid across the hook. As the latch needle continues with its downward motion the newly supplied yarn is drawn through the knitted loop. Latch needles thus knit automatically, and the opening and closing of the hook is carried out by the knitted loop without using additional knitting elements. Current practice is to arrange latch needles in the tricks or grooves of a needle bed, as is explained in greater detail below.

Thus, latch needles have to be reciprocated between two fixed dead centres to form new knitted loops, and one complete oscillation of the needle is known as the knitting cycle. The reciprocating movement of the needles is achieved by moving a system of cams on the top surface of a needle bed.

During the early stage of the backward needle movement, a yarn is laid across the opened needle hook area by a yarn feeding element (in flat bed knitting the yarn feeding element is called a yarn carrier). Shortly afterwards, the knitted loop on the needle stem forces the latch to rotate and close the hook due to its relative movement towards the hook. As the needle continues to move backwards the knitted loop moves on to the latch and then is cast off.

During the final stages of the backward needle movement, the yarn in the hook is pulled through the cast off knitted loop, thus forming the new knitted loop and converting, at the same time, the previous knitted loop into a stitch.

Alternatively, compound needles may be used in place of the latch needles with the provision that the compound needle is not self-acting as described above and requires opening and closing during the loop formation cycle.

The function of the needle bed is to hold and guide latch and needles. The needle beds are made out of high quality metal blocks, a representative prior art needle bed 22 being shown in FIG. 2. On one surface of the block 22 parallel grooves 24 of equal width are machined at equal distances. Latch needles are placed inside these grooves and moved mechanically between two dead centres. The grooves are commonly called needle tricks. The distance between two adjacent needle tricks is called the needle space (t). The needle tricks are wider at the top edge, where the needle hook is placed, to accommodate the somewhat bigger knitted loop. This edge also builds the knocking over edge (verge). The shape of the metal block depends on the type of the knitting machine.

Flat bed knitting machines are typically equipped with two flat needle beds arranged in the form of a roof. The important parts of a flat needle bed are shown in FIG. 3, which depicts a latch needle 30 in place in the groove of a needle bed 32. The wall 34 of the groove is shown in FIG. 3, together with the needle security spring 36, needle cover band 38 and knock over jack 40. The needle cover band 38 maintains the knitting needles against the base of the needle bed 32. It also has a braking effect on the knitting needles and prevents them from springing back.

The movement of the latch needles between two dead centres is technically realised by means of inclined metal planes. These operate at a defined distance above the needle bed and act on the butts of latch needles. These inclined planes are called knitting cams and are usually fixed on to a cam plate. FIG. 4 shows the knitting cams, 42, 44, 46. Additionally, FIG. 4 depicts a number of elements which are shared with FIGS. 1 and 2: common numerals are used to denote such shared elements.

The central cam 42 raises the knitting needles. The central cam 42 is also known as the raising cam in the art. The lowering or stitch cams 44, 46 lower the raised knitting needles and prevent the raising needles from overshooting. The stitch cam 44 (on the left hand side of FIG. 4) lowers the knitting needles when the cam plate moves on the needle bed from right to left, as shown in FIG. 4. Meanwhile the other lowering cam 44 acts as a guiding cam. When the cam plate moves on the needle bed from left to right the raised knitting needles are then lowered by the right stitch cam 46. The two elements, the raising cam and the lowering or stitch cams, are employed in all types of knitting machines with latch needles, whether they be circular weft knitting machines or flat bed weft knitting machines, manual or automatic. In general the raising cam and the lowering cams form a track for the needle butt and is thus called the cam track. Only the needles whose butts fall into the cam track can participate in the knitting process.

Prior art flat bed knitting machines are precisely engineered with two needle beds of hardened steel that are arranged in an inverted V-form. In the needle beds, needles are placed inside needle tricks (typically open rectangular grooves precisely cut with a tolerance of about +40 μm to accommodate needles with a tolerance of −40 μm on the top surface of the needle bed). This arrangement facilitates the movement of needles individually and linearly during the knitting process. The introduction of the needle-latch or closing element to open and close the needle hook area simplifies the stitch formation process. The combination of needle tricks and latch needles have paved the way for the creation of complex 3-D structures on these machines.

The three prerequisites for the stitch formation process include the linear movement of the latch needle, the control of the knitted loop during this movement and the delivery of yarn into the open needle hook. In order to move the needles independently, it is necessary that there is a mechanism for their selection. The mechanisms for needle movement (cam plate) and selection are included in a carriage that is reciprocated along the needle beds. The needle movement is achieved using cams and the needle selection mechanism(s) brings the butts of pre-defined needles into the track of the cams. Currently, this is achieved via two techniques. On modern machines additional elements, called needle selection jacks, are positioned below the latch needle; needle beds with extended tricks are used in order to accommodate the selection jacks. One of the techniques is to press down the needle butt into the needle bed by using special cams shortly after the needle has completed the knitting cycle. Such a needle will remain in this position until it is released by its selector jack and the needle butt will not come into contact with the cam track; thus it will remain inactive and, therefore, cannot form a knitted loop. This is known generally as missing and will result in the creation of a float in the knitted structure. The second technique is to position the needle so that its butt is below the cam track soon after the completion of the knitting cycle, again using special cams. In this position the needle will remain idle until its selector jack re-positions the needle so that its butt could follow the cam track. On modem electronic knitting machines the selection mechanism is based on electromagnetic methods, and the selection system has been integrated on to the cam system, ie, the electromagnetic selection system is positioned in front of the knitting cam system. As a result the needles are selected always in advance to the cam system.

Industrial flat-bed knitting machines are constructed with two needle beds that are arranged in the roof form. Latch needles are placed in grooves of the needle beds, and reciprocated between the two fixed dead centres by moving a system of cams on the top surface of each needle bed. The cam systems of the two needle beds are connected to each other with a metal arm, called the bow, and the entire unit is known as the carriage, which describes a transverse reciprocating movement between the left and right hand ends of the needle beds during knitting. The yarn is guided to the needles with a yarn carrier, which is taken along by the bow of the moving carriage. As the yarn carrier traverses under the bow, the yarn path is maintained parallel to the top edges of needle beds. In flat bed knitting machines the yarns are guided to yarn carriers from the sides of the machine (needle beds), so that the yarn path is straight and to avoid interference from moving parts. At least one spring loaded cymbal tensioner is integrated into the yarn path in order to maintain the yarn under tension, and a return spring is fixed next to the yarn package in order to take the excess yarn back at the early stage of the carriage movement towards the yarn guiding side of the needle beds. In some flat bed knitting machines additional take-back springs are provided at the side of the needle beds, in order to assist the yarn take back action.

Ideally, in weft knitting the needles should have only one function, ie, to form stitches, but, in practice, in order to carry out the above function the knitting needles also must pull the required length of yarn from the yarn package. The result is that the run-in yarn tension will be much higher than the yarn unwinding tension at the package, because the yarn has to overcome all the frictional drag along its patch.

The schematic diagram in FIG. 5 demonstrates the path of the yarn on a modern electronic flat-bed knitting machine, shown generally at 50. The knitting machine 50 comprises a yarn carrier 52 delivering yarn 54 to a needle (not shown), yarn guides 56, 58, 60, 62, 64, 66 yarn take-back spring 68, a cymbal tensioner 70 and a yarn package 72.

A transverse reciprocating carriage takes the yarn carrier 52 along with it and thus also influences the run-in-yarn tension; in fact, it causes the run-in-yarn tension to vary during the knitting of alternating courses, which is caused due to the unwinding of unequal lengths of yarn from the yarn package depending on the direction of the carriage movement. Another important factor is the yarn velocity. At the beginning of knitting a new course, the carriage, which takes the yarn carrier along with it, accelerates from zero velocity until it reaches its nominal knitting velocity, and at the opposite end of the needle bed, ie, shortly before the end of that course, it is decelerated and brought to rest. This results in a discontinuous yarn movement.

In order to address the difficulties encountered with adequately delivering an amount of yarn during knitting operations, various positive yarn feed devices have been developed. The basic principle underpinning positive yarn feeding (delivery) is the delivery of a predetermined length of yarn to the needles. The object is to ensure that each row of stitches formed by a given number of needles (called a course in knitting) will be of a constant length of yarn. The positive yarn feeding was first employed in multi-feeder circular knitting machines. It should be noted that needle cylinders are used in conjunction with circular knitting machines, instead of flat needle beds. A needle cylinder is made from a hollow metal cylinder. On circular knitting machines the yarn is delivered to the needles at a constant velocity by using positive feed systems. The yarn delivery velocity is calculated prior to knitting using a simple equation:

stitch length×the total number of needles=the length of the yarn to be delivered per machine revolution.

The positive yarn feeding devices are then adjusted to deliver this amount of yarn to the needles per needle cylinder revolution.

This simple method of yarn delivery is not suitable for delivering yarn on a flat-bed knitting machine due to the discontinuous yarn movement. On a circular knitting machine the distance between yarn feed wheel and the point at which the yarn is delivered to the needles is a constant. In contrast, in flat-bed knitting this distance varies according to the yarn carrier position, which in turn is defined by the carriage position, and, more precisely, by the position of the needle that is knitting.

A positive yarn feed system for a flat-bed knitting machine which is intended, at least in part, to overcome these problems is described in Kennon et al (W R Kennon, T Dias and P Xie, J. Text. Inst., 2000, Part 3, 140). In this system, a positive yarn feed device having a servomotor is employed. Before knitting of a fabric panel commences, a personal computer (PC) is provided with CAD data containing information relevant to the knitting of the fabric panel to be produced, including details of the sketch length, the number of needles the knitting is to span and the required fabric structure. The PC communicates with a microprocessor which in turn controls the servomotor on the positive feed device in accordance with these data. The knitting machine described in Kennon et al is primarily an academic, proof of principle system, and suffers from a number of drawbacks which prevent practical usage for knitting items such as articles of clothing and patterned fabrics. Firstly, the delivery of yarn by the positive feed device can become erroneous if, as is often the case in practice, the knitting operation loses synchronisation with the pre-programmed knitting pattern. Secondly, the feed system of Kennon et al does not properly account for variations in factors such as the coefficient of friction of the yarn and run-in yarn tension. Thirdly, the feed system of Kennon et al is only capable of knitting a very simple fabric comprising rows of stitches of constant stitch length. The machine and methodology of Kennon et al is unable to knit a course with different patterning elements (such as stitches, tuck loops, etc). Clearly, this is a very major obstacle to practical, commercial usage.

The present invention overcomes the aforesaid problems and disadvantages in the prior art, and provides improved knitting machines and methods of knitting.

According to a first aspect of the invention there is provided a knitting machine comprising:

at least one knitting needle;

at least one positive yarn feed device for feeding yarn to said at least one knitting needle;

needle monitoring means for providing information relating to the at least one knitting needle during the course of a knitting operation; and a controller for controlling the operation of the positive yarn feed device;

in which the controller is adapted to: receive information from the needle monitoring means during the course of a knitting operation; use said information to calculate a desired amount of yarn to be fed to a knitting needle; and control the positive yarn feed device so that the positive yarn feed device feeds the desired amount of yarn to the knitting needle during the course of the knitting operation.

Knitting machines of the present invention calculate the correct lengths of yarn required for each patterning element, such as stitches, tuck loops, floats, etc., during the course of the knitting process and thus remain synchronous with the knitting process. Furthermore, complex fabrics can be knitted using the present invention, including patterns where needle speed is varied, stitch lengths, tuck loop lengths or in-lay lengths are varied, knitted Jacquard fabrics and shaped fabrics. A further advantage is that cam box traverse speed may be varied. Furtherstill, the yarn tension may be accounted for so as to achieve constant stitch lengths and to compensate for variations in the yarn package and the coefficient of friction of the yarn. A further benefit still is that knitting operations can be carried out under reduced tension conditions, permitting higher production speeds to be achieved without risk of yarn breakage. The present invention also enables fabric panels of same dimensions to be produced on a repetitive basis. Also, needle selection can be used to change the knitted structure and produce fabrics with different held loops or transfer loops. Latch needles or compound needles may be used.

Another term for "positive yarn feed device", used in the art is "precision yarn feed device". For the avoidance of doubt, the present invention includes within its scope precision yarn feed devices for delivering a predetermined length of yarn.

The needle monitoring means may provide needle selection data. In this way, the positive yarn feed device can be operated to deliver the precise amount of yarn required for a given patterning element, such as a stitch, tuck loop or a float and to remain in synchronisation with the needle(s) during the knitting process.

The needle monitoring means may provide needle position data, and the controller may use said needle position data to control the positive yarn feed device. The needle position data may comprise a plurality of position signals, which may provide essentially continuous monitoring of needle position. Conveniently, needle position data may be provided by one or more yarn carriage position detectors. Encoder devices, especially linear encoders, are suitable for providing position data.

The positive yarn feed device may comprise a servomotor which is controlled by the controller.

The knitting machine may further comprise at least one stitch cam, in which the operation of the stitch cam is controlled by the controller during the course of a knitting operation. The stitch cam may comprise a stitch cam motor for varying the position of said stitch cam, and the operation of the stitch cam motor may be controlled by the controller during the course of a knitting operation. The stitch cam motor may comprise a stepper motor. The stitch cam motor may comprise a servomotor.

The controller may control the operation of the stitch cam so as to produce knitted loops of predetermined characteristics, preferably a predetermined stitch length.

The knitting machine may further comprise fabric take down means, in which the operation of the fabric take down means is controlled by the controller during the course of a knitting operation. The fabric take down means may comprise a fabric take down motor, and the operation of the fabric take down motor may be controlled by the controller during the course of a knitting operation. The fabric take down motor may comprise a servomotor.

The controller may control the operation of the fabric take down means in accordance with the stitch length employed by the knitting machine.

The knitting machine may further comprise tension measuring means for measuring the tension of yarn fed to the at least one knitting needle; in which the yarn tension measured by the tension measuring means is communicated to the controller, and the controller utilises the measured yarn tension to control the knitting operation. The controller may control the operation of the stitch cam in accordance with the yarn tension measured by the tension measuring means. For example, if the yarn tension is less than a desired value, the stitch cam might be lowered in order to compensate by increasing the yarn tension. Conversely, if the yarn tension is greater than a desired value, the stitch cam might be raised in order to reduce yarn tension.

The controller may control the operation of the fabric take down means in accordance with the yarn tension measured by the tension measuring means.

The controller may control the operation of the fabric take down means in accordance with the stitch length The controller may control the operation of the fabric take down means so as to control fabric take down tension.

The controlling methodologies described above can be implemented in closed loop or open loop control modes. It is possible for all of the control methodologies to be implemented in closed loop, all of the control methodologies to be implemented in open loop, or for a mixture of closed and open loop control to be employed.

The knitting machine may be a flat bed knitting machine. However, the present invention can be utilised also in conjunction with other types of knitting machines, such as circular knitting machines, in particular circular knitting machines with electronic needle selection.

According to a second aspect of the invention there is provided a method of knitting comprising the step of:

knitting a knitted structure with at least one yarn whilst supplying an amount of said yarn to at least one knitting needle using at least one positive feed device;

the method further comprising the steps of:

providing information relating to the at least one knitting needle during the course of the knitting;

using said information to calculate a desired amount of yarn to be fed to a knitting needle; and controlling the positive yarn feed device so that said device feeds the desired amount of yarn to the knitting needle during the course of the knitting.

Needle selection data may be provided.

The method may further comprise the step of controlling the operation of a stitch cam during the course of the knitting. The step of controlling the operation of the stitch cam may comprise controlling the operation of a stitch cam motor, which stitch cam motor varies the position of said stitch cam.

The operation of the stitch cam may be controlled so as to produce knitted loops of predetermined characteristics, preferably a predetermined stitch length. This may be achieved at reduced yarn tension.

The method may further comprise the step of controlling the operation of fabric take down means during the course of the knitting. The step of controlling the fabric take down means may comprise controlling the operation of a fabric take down motor.

The operation of the fabric take down means may be controlled in accordance with the stitch length employed during the knitting.

The method may further comprise the step of measuring the tension of yarn fed to the at least one knitting needle, in which the measured yarn tension is utilised to control the knitting. The operation of the stitch cam may be controlled in accordance with the measured yarn tension.

The operation of the fabric take down means may be controlled in accordance with the measured yarn tension.

The knitting may be performed on a flat bed knitting machine.

The stitch length may be varied.

Embodiments of knitting machines and methods in accordance with the invention will now be described with reference to the accompanying drawings, in which.

Figure 1A:
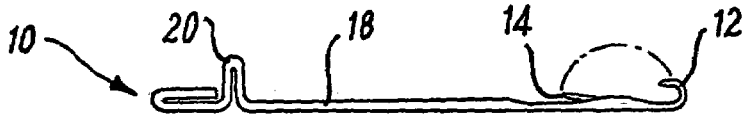
FIG. 1(a) Prior Art
FIG. 1 shows (a) a side view and (b) a magnified side view of a latch needle.
Figure 1B:
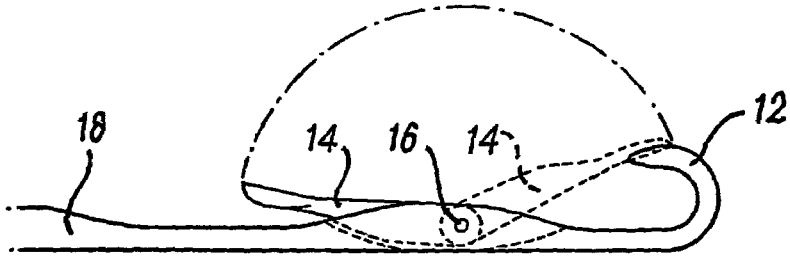
FIG. 1(b) Prior Art
Figure 2:
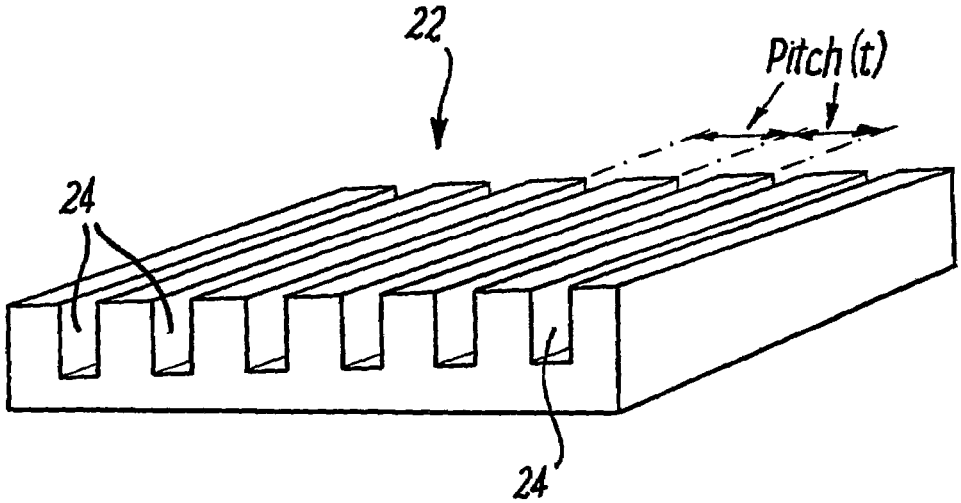
FIG. 2 Prior Art
FIG. 2 shows a flat needle bed.
Figure 3:
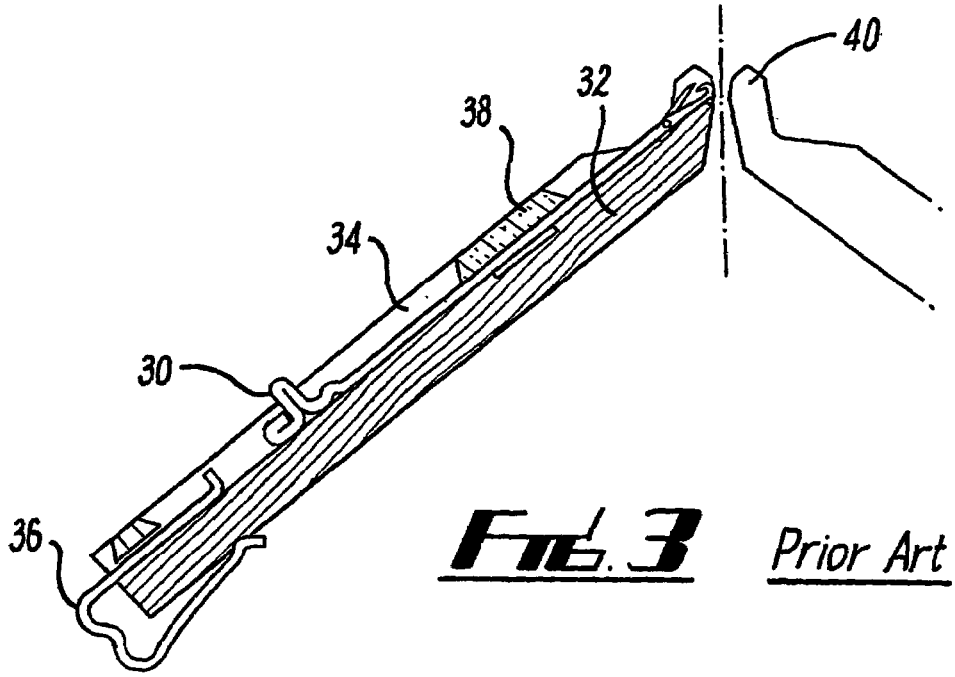
FIG. 3 Prior Art
FIG. 3 is a cross sectional view of a flat needle bed.
Figure 5:
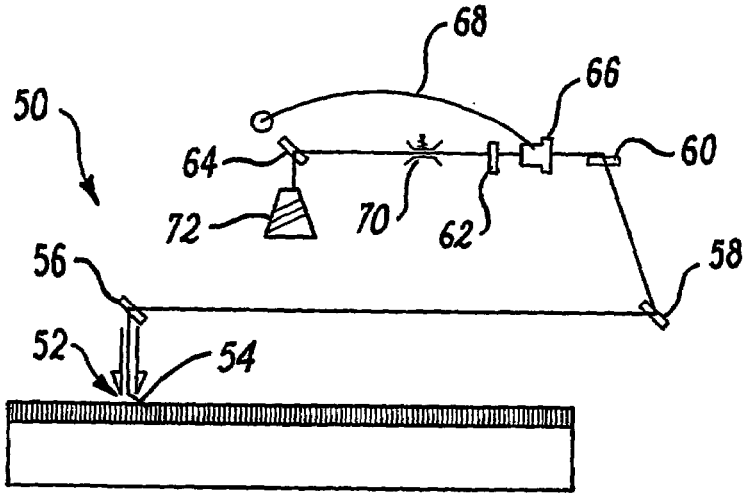
FIG. 5 Prior Art
FIG. 5 shows the yarn path in a flat bed knitting machine.
Figure 4:
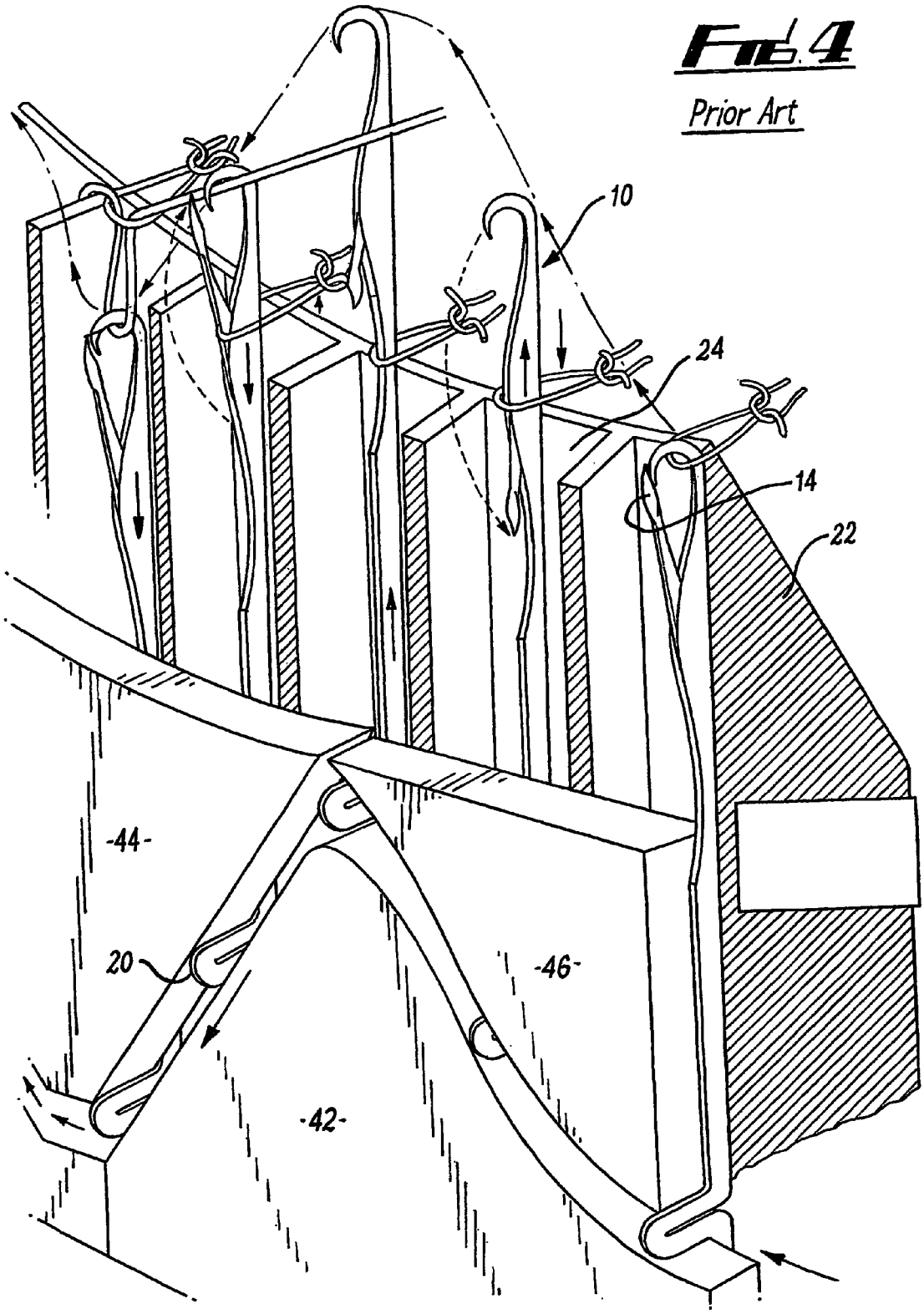
FIG. 4 Prior Art
FIG. 4 shows a knitting cam system.
Figure 6:
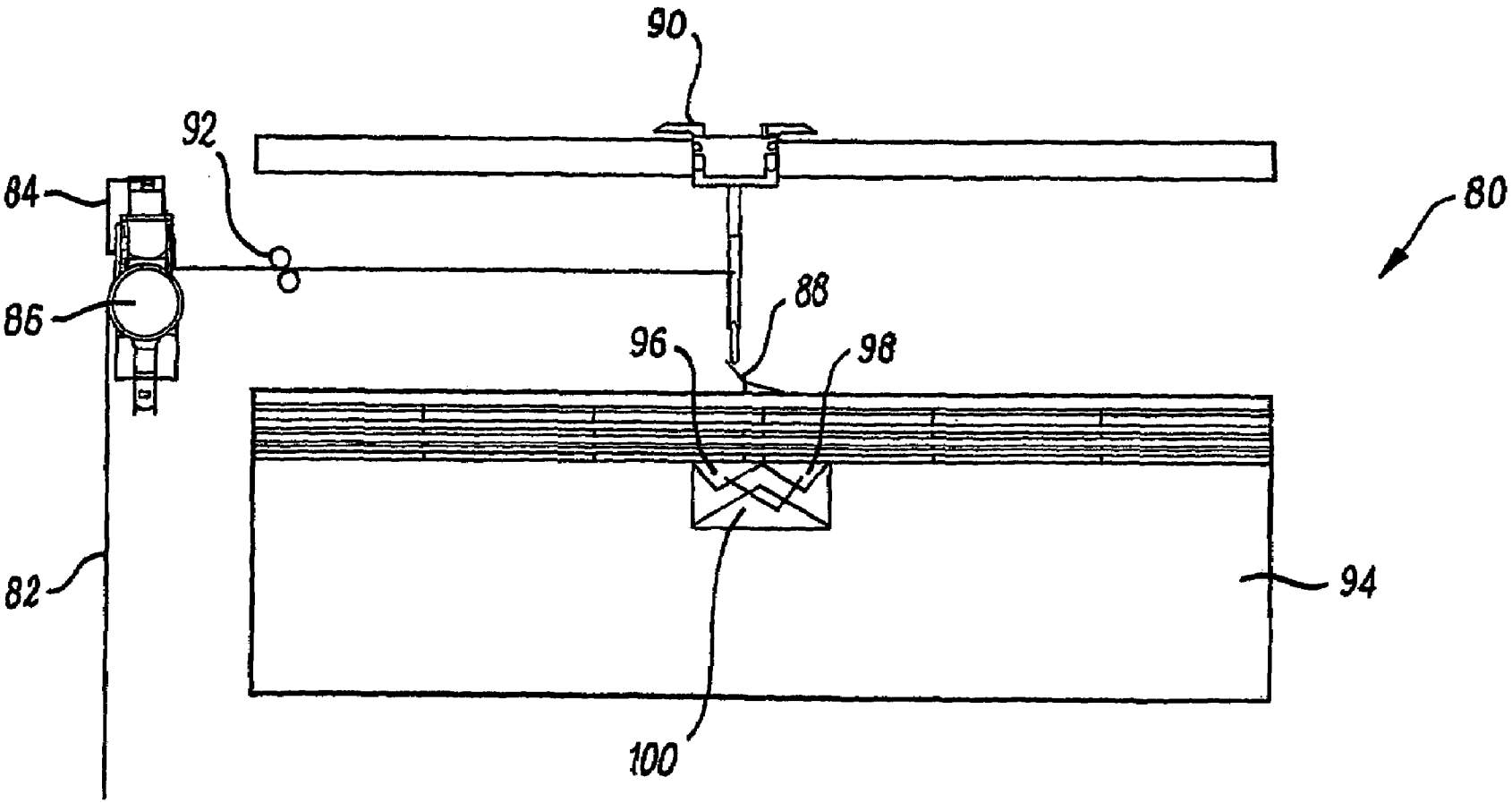
FIG. 6 shows an embodiment of a flat bed knitting machine of the present invention.

FIG. 6 shows an embodiment of a flat bed knitting machine 80 for knitting a fabric from yarn 82 supplied to the machine 80. The yarn 82 is supplied from a yarn package (not shown) to a positive yarn feed device 84 which includes a positive feed drum 86. The positive feed device 84 delivers a precise quantity of yarn 82 to a knitting needle 88. The yarn 82 to the knitting needle 88 is delivered by a yarn carrier 90. The tension of the yarn fed to the knitting needle 88 from the positive feed device 84 is measured by tension measuring means 92. Also depicted in FIG. 6 are the needle bed 94, stitch cams 96, 98 and raising cam 100. The system for providing yarn from the yarn package to the positive feed device 84 and the tension measuring means 92 can utilise a number of prior art arrangements, such as those disclosed in Kennon et al, the contents of which are herein incorporated by reference. The positive feed device 84 preferably utilises a servomotor to actuate the feeding of yarn into the knitting machine 80. High speed servomotors such as brushless dc servomotors are particularly preferred. Further constructional details of suitable positive feed devices can be found in Kennon et al.

Figure 7:
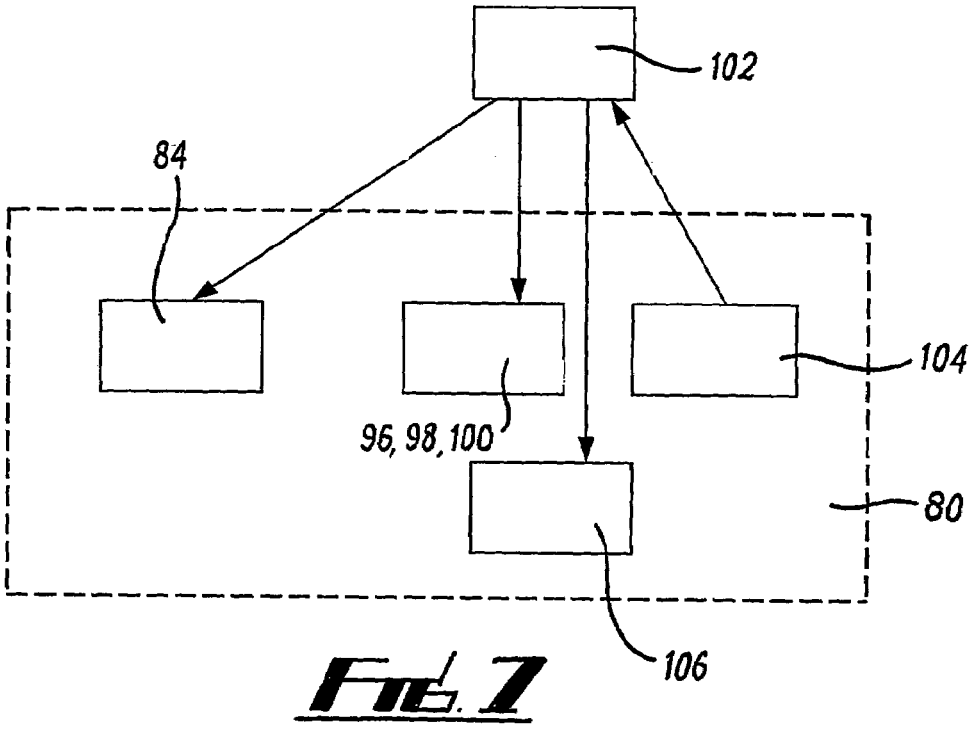
FIG. 7 is a schematic diagram of a control arrangement for controlling the knitting machine of FIG. 6.

FIG. 7 depicts in schematic form a control arrangement for controlling the operation of the knitting machine 80 of FIG. 6. Identical numerals are used to denote elements which are shared between FIGS. 6 and 7. The control arrangement comprises a controller 102 which is linked to the positive feed device 84 so as to control the operation of the positive feed device 84, in particular to control the precise amount of yarn which is delivered by the positive feed device 84. The controller 102 controls the positive feed device 84 in accordance with data provided to it by needle monitoring means 104 disposed on the knitting machine 80. These data are provided whilst the knitting operation is underway and are used by the controller 102 to calculate the correct amount of yarn which should be supplied by the positive feed device 84 for any given patterning element such as a stitch, a tuck loop or a float to be made during the knitting operation. In this way, the control system can operate "on the fly", reacting and adapting to operational variations as they occur during the knitting process. In preferred embodiments, the needle monitoring means 104 provides needle selection data: such digital data is provided by many modern electronic knitting machines, and the provision of such needle selection signals is well known in the art. However, the use to which the present invention puts the needle selection signals is not known in the art. The controller 102 might comprise a computer, such as a personal computer, a microprocessor or any other suitable form of controlling device. Any suitable control protocol might be employed. Typically, control pulses are supplied to drive the motor on the positive feed device 84 in a controlled manner in order to deliver the calculated amount of yarn. The motor on the positive feed device 84 (which drives the feed drum 86) can operate in an open loop or closed loop manner, although preferably a closed loop servomotor is used. It is possible for the controller 102 to exist at different discrete locations; for example, the controller 102 might comprise a computer or microprocessor which communicates with a microprocessor disposed in the positive feed device itself, with this latter microprocessor supplying pulses which actuate the motor of the positive feed device.

In a preferred variant of the invention, the controller 102 also controls the stitch cams 96, 98. It is also possible to control fabric take down means 106 of the knitting machine 80 using the controller 102. Both of these control methodologies—of the stitch cams and the fabric take down—can be performed in accordance with the measured tension of the yarn, these data being supplied as the controller 102 from the tension sensing means 92. Control methodologies will now be described in more detail below.

The control of the yarn, delivered by the positive feed device, afforded by the present invention permits the correct amount of yarn to be fed for any given stitch or other patterning element during the course of a knitting operation.

The concept has the following advantages:

the same length of yarn can be delivered for each needle;

the length of yarn delivered could be varied for each needle, which would allow a greater knit design flexibility, such as creating areas with stitches of different sizes within a knitted structure, integrating tuck loops and floats within a row of stitches etc.

Figure 8:
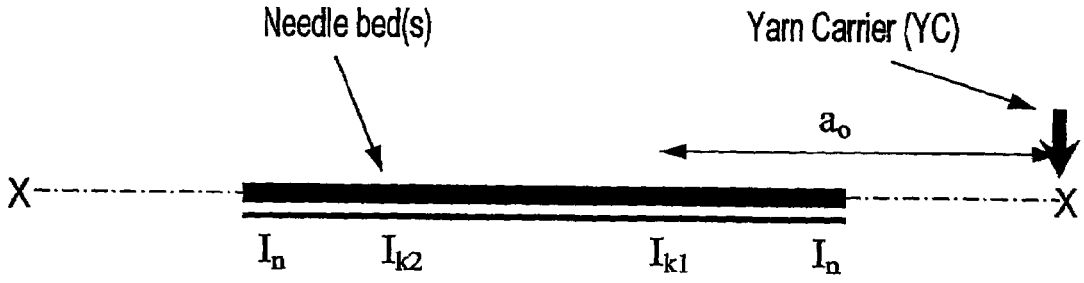
FIG. 8 is a schematic diagram to illustrate yarn carrier movement during the knitting process.

The practical realisation of the above provided by the present invention involves a control theory which is set forth below. In modem electronic flat bed knitting machines, the yarn carriers are parked outside the needle area, this being done in order to improve the accessibility of the yarn carriers to machine operators. The yarn carrier parking positions X are shown in FIG. 8. If, for example, it is desired to knit a rectangular panel, this would require knitting on a fixed number of needles (say 300 needles) to achieve the required width of the panel and repeat knitting on the same 300 needles over a number of courses (rows of stitches, say 500 courses). Generally, each carriage movement would create a course, and, therefore, this would require 500 carriage movements. During this movement the carriage would be moving 250 times from left to right, and 250 times from right to left. In FIG. 8 the 300 needles are marked with $l_{k1}$-$l_{k2}$; the needle bed would have more than 300 needles which would span across $l_n$-$l_n$.

Modern flat bed knitting machines are programmed to carry out the knitting in the middle of the needle bed. The CAD/CAM system(s) which are provided by machine manufacturers are programmed to do this automatically unless one wishes to position the knitting area on the left hand side or the right hand side of the needle bed, which is not the standard practice.

At the beginning of the knitting process the carriage will move to the right hand side of the machine to pick up the yarn carrier, and then it will move towards the left hand side of the machine with the yarn carrier. During this time the positive feed device must deliver the yarn so that the yarn carrier could move with the yarn—failing to achieve this would result in yarn breakage. Electronic flat bed knitting machines are equipped with linear encoders, which generate a precision rectangular wave form, eg, a fixed number of pulses of rectangular shape are generated for every mm of the carriage movement. Generally, a linear encoder is provided for each needle bed. Suitable devices, such as optical and electromagnetic encoders, are well known. The exact position of the carriage at any given time can be determined with these pulses; these are two of the signals used by the positive feed device, and will be referred to as the Position Signals (PS). The servomotor of the positive feed device which drives the yarn feed wheel drum, is synchronised to the signal PS. This can be achieved by driving the servomotor in stepper emulator mode. For each positive pulse of the PS the servomotor shaft is turned by a number of degrees; the number of degrees would depend on the circumference of the feed wheel and the length of yarn that needs to be delivered. The positive feed device controller generates and transmits a stream of electronic pulses to the servo motor control unit. Until the carriage has reached the position $l_{k1}$ the servomotor is driven to deliver a yarn length $a_o$ (FIG. 8).

Figure 9:
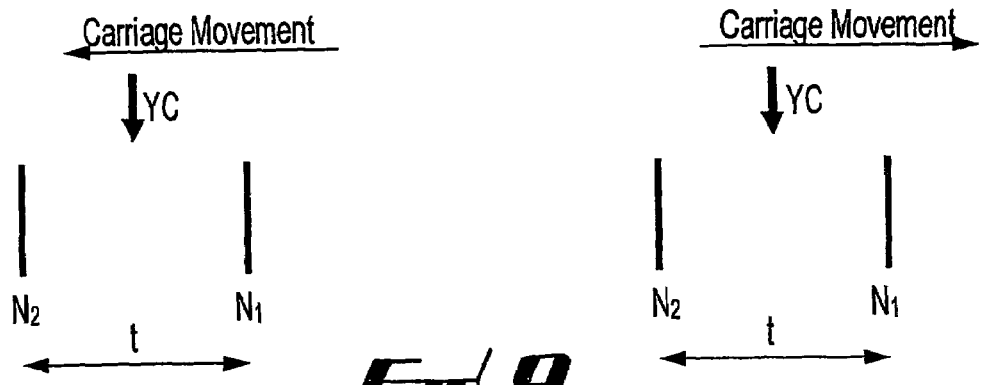
FIG. 9 shows the length of yarn delivered in relation to the yarn carrier position fpr the instances in which (a) the yarn carrier is moving from right to left and (b) the instance in which the yarn carrier is reversing.

FIG. 9 can be used to calculate the length of yarn that needs to be delivered by the positive feed device when the yarn carrier moves between the two neighbouring needles $N_1$ and $N_2$. In the first case (FIG. 9*a*) the positive feed device has to deliver a total length of yarn $L_T$ which is given by:

$$L_T = L_{SL,F} + L_{SL,B} + t \quad (1)$$

Where $L_{SL,F}$ is the stitch length to be formed by a needle on the front needle bed;

$L_{SL,B}$ is the stitch length to be formed by a needle on the back needle bed; and t is the distance between two neighbouring needles (pitch).

On the other hand the yarn carrier is moving from left to right (FIG. 9*b*), the positive feed device has to deliver a total length of yarn $L_T$ given by:

$$L_T = L_{SL,F} + L_{SL,B} - t \quad (2)$$

The justification for these statements is that when the yarn carrier is moved from $N_1$ to $N_2$ the positive feed device has to deliver the length of yarn that is required to form a stitch (stitch length) and also the length of yarn t, and this length t is already available for stitch formation when the yarn carrier is moving from $N_2$ to $N_1$.

The positive feed device controller calculates the number of pulses required for the positive feed device servomotor to deliver the correct length of yarn according to equations 1 or 2, and transmits the pulses to the servomotor controller. Whether the needles $N_1$ and $N_2$ are going to knit will depend on the pattern information, which is available at the needle selection unit. If a needle is not going to knit (miss position) then a zero value is substituted for $L_{SL}$ in the equations 1 and 2. Therefore, yarn is delivered according to the needle selection signals.

It should be noted that the hardware utilised generally comprises a memory buffer. Typically, the needles are selected in advance on the knitting machine (a representative figure being 18 needles in advance). It is convenient to calculate the number of servomotor control pulses in advance as well as using the needle selection data. Advantageously, these control pulse values are stored on a FIFO (First In First Out) memory buffer.

Figure 10:
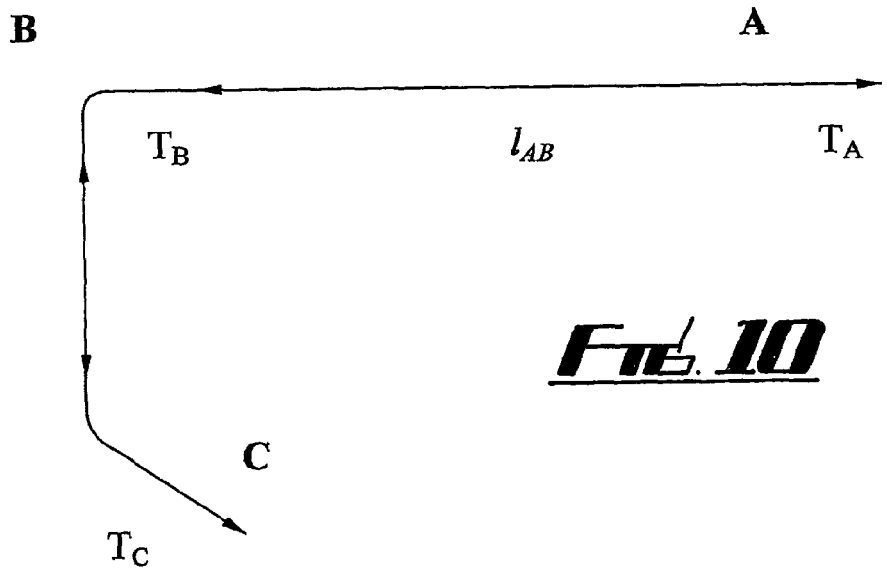
FIG. 10 shows the basis of a mathematical model for yarn delivery from a positive feed device.

A mathematical model for yarn delivery from the positive feed device is presented below with reference to FIG. 10. The following notation is used:

| | |
|---|---|
| $mg_0$ = | initial weight of yarn |
| A = | cross sectional area of yarn |
| ρ = | linear density of yarn |
| g = | acceleration due to gravity |
| mg = | weight of yarn mass between A and B |
| Δt = | small duration of time |
| $Strain_{AB}$ = | strain in AB |
| $Strain_{TC}$ = | strain in TfC |
| L = | straight line distance between A and B |
| $l_{AB}$ = | yarn length between A and B |

The initial yarn mass between A and B is given by $mg_o = 2A\rho g$

In delivering yarn using the positive feed device, when the carrier traverse is away from the yarn delivery system, the yarn delivered per each trick distance movement is equal to the trick distance plus the stitch length.

In delivery the positive feed device, when the carrier traverse is towards the yarn delivery system, the yarn delivered per each trick distance movement is equal to the stitch length minus the trick distance.

Dynamic yarn mass and length AB between the carrier and the yarn delivery system when yarn delivery is done using the positive feed device is defined as $$mg = mg_0 + ((\text{Stitch velocity} \pm \text{Carrier velocity}) \times \Delta t \times A\rho g) - \frac{(\text{Stitch velocity} \times \Delta t \times A\rho g)}{1 + strain_{TC}}$$

$$l_{AB} = \frac{mg(1 + Strain_{AB})}{\rho A g}$$

$$L = l_{AB} - \frac{w^2}{T_{AB}^2}\left(\frac{l_{AB}^3}{24} + \frac{l_{AB}}{\lambda^2} - \frac{3l_{AB}^2}{8\lambda \tanh 0.5\lambda l_{AB}} - \frac{l_{AB}^3}{16\sinh^2 0.5\lambda l_{AB}}\right)$$

Where λ is written for $$\sqrt{\frac{T_A}{B}}$$

Run-in-yarn tension is given by the following equation $$T_{run\text{-}in\text{-}yarn} = T_{AB} e^{\mu \times \frac{5\pi}{6}}$$

The physical reasons for the occurrence of stitch length variation will now be discussed. It is known from the research of Doyle, Munden and Knapton (Doyle, P J, 1953, J. Text. Inst, 44, 561; Knapton, J J F and Munden, D L, 1966, Text. Res. J., 36, 1072 and 1081; Munden, D L, 1959, J. Text. Inst., 50, 448) that the linear dimensions of a knitted structure are determined by the stitch length and that all other variables influence the dimensions only by changing the stitch length. The stitch length of a knitted fabric can be influenced only during the stitch formation process. The standard method of altering the stitch length of a fabric on a flat bed knitting machine is by adjusting the position of the lowering cams, ie, by varying the knocking over depth of the needles. Unfortunately other processing parameters such as the run-in yarn tension (the tension of the yarn just before its being supplied to the first needle of the knitting zone), yarn friction and fabric take down also influence the size of the stitches formed. Previous research indicates that in the knitting zone, as the yarn comes into contact with the knitting elements, its tension builds up continuously until a maximum value is reached.

Figure 11:
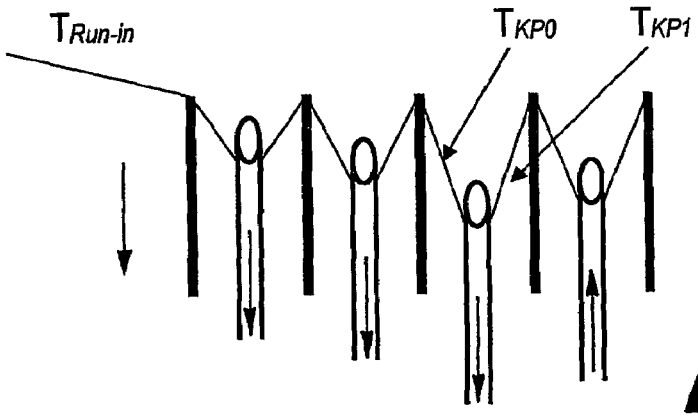
FIG. 11 shows yarn tension build up in the knitting zone.

Assuming that this tension build up obeys Euler's capstan equation of yarn friction, the tension in the trailing leg of the knitted loop that is being formed can be expressed mathematically as $$T_{KP0} = T_{run\text{-}in} e^{\mu\theta} \quad (1)$$

where:

$T_{KP0}$ is the yarn tension in the trailing leg of the knitted loop (see FIG. 11);

$T_{KP1}$ is the yarn tension in the leading leg of the knitted loop (see FIG. 11);

$T_{run\text{-}in}$ is the run-in yarn tension;

μ is the mean coefficient of friction between thee yarn and the knitting elements; and θ is the sum of the angles of wrap in radians between the yarn and the knitting elements which are in contact with the yarn.

Theoretically, the needles must pull the required length of yarn from the yarn package in order to form knitted loops, but during the final phase of the knitted loop formation the yarn can also move from the knitted loop on a needle that has already completed its knitting cycle, ie, a leading needle. This phenomenon, known as "robbing back", was first suggested by Knapton and Munden and also influences the stitch length. This flow of yarn from an already formed knitted loop would depend on the magnitude of yarn tension components $T_{KPO}$ and $T_{KP1}$, ie, if the yarn tension in the lagging $leg_{KP}T_O$ exceeds the tension in the leading leg $T_{KP1}$ then yarn would flow from the previously knitted loop rather than from the yarn package. Another factor to be considered is the extension of the yarn due to its tension during knitting. In fact it has been demonstrated that one has to expect average yarn tension values up to 150 cN during stitch formation. It is also reported that short term yarn tension peaks in the order of 600-1000 cN are not unknown. It is reasonable to assume that any yarn will elongate when it is under tension, and therefore reasonable to assume that during the formation of the binding elements (stitches, knitted loops and truck loops) the yarn would elongate and secondly that the major component of this extension would be elastic. After the formation of the binding elements the yarn tension would be reduced, and this would cause the knitted yarn to relax. Thus, the stitches formed would be shorter in length than the nominal stitch length, with the difference depending on the degree of elastic extension of the yarn during the knitting process.

The factors which influence the yarn tension can be explained as follows. Due to the needle movement an amount of yarn is demanded by the needles during knitting to form the stitches or other patterning element(s). On the other hand the positively driven feed wheel will deliver a pre-determined length of yarn to the needles. As such we have a "demand and delivery" situation, in which three scenarios can be identified:

| | | |
|---|---|---|
| 1. | demand = delivery | the yarn tension will be near zero; |
| 2. | demand < delivery | the yarn tension will be slack and can interfere with the carriage movement; |
| 3. | demand > delivery | the yarn tension will increase. |

As demonstrated above the tension in the yarn will only be influenced by the length of the yarn demanded by the needles and the length of the yarn delivered to the needles from the feed wheel.

The present invention provides a number of control models which are cognizant of these physical phenomena. Firstly, as described above, the positive feed device is controlled to deliver the yarn required to form a stitch (or any other patterning element) of a predetermined length. This can be regarded as the main control loop. The next phase is to ensure that the needles form a stitch (or any other patterning element) with the yarn delivered; this is possible by a second control loop in which the position of the stitch cam is controlled. For example, if the yarn, tension goes slack, the stitch cam can be pulled down a little harder in order to compensate. Conversely, if the tension is too high, the stitch can position might be raised somewhat so as to reduce yarn tension. In practical terms it may not be advisable to carry this operation out for each stitch as it may result in fabrics of an uneven appearance. Therefore, this operation may be carried out more infrequently, such as when the stitch length is changed and during knitting in an integral manner perhaps over several needles. Similarly, in a third control loop the fabric take down system can be adjusted to match the stitch size (stitch length). As before, this can be carried out only when the stitch length is altered. One possible control regime involves measurement of the current of the take down motor. Thus, higher current indicates a higher motor torque being used to pull the fabric down. It is possible to use this information to control the take down tension. The second and third control loops can be operated in open loop or closed loop modes. The control regime of the present invention can correct for variations in the yarn package and the coefficient of friction of the yarn. Such variations give rise to particular difficulties in the case of dyed yarns, to the extent that it is common to knit with undyed yarn and then dye the knitted fabric, which is an unsatisfactory approach. Thus, it is advantageous that fabrics can be knitted conveniently with dyed yarns using the present invention.

It should be noted that in practice, knitting machines generally comprise a plurality of cam systems and a plurality of needle beds. Thus, there are several needle selection signals, since needle selection is carried out for each cam system on the carriage and then separately for the two needle beds, eg, for a 3 system machine there are six different selection signals. The calculated yarn length can be delivered to the needles according to the position signal, as previously disclosed. Yarn carrier selection signals can be used to determine when a positive yarn feed device should begin to deliver yarn. For example, many current electronic flat-bed knitting machines are designed with sixteen yarn carriers. Normally, one yarn carrier is used to knit a course with one cam system, and an electromechanical yarn carrier selection mechanism is provided (typically on the base of the carriage). The signals used to operate the yarn carrier selection can also be employed in the present invention to operate the positive yarn feed device(s). Typically, each yarn carrier is threaded with a separate yarn which can be controlled using separate positive yarn feed devices. In a further embodiment of the invention, the yarn carrier selection signals are used to start operation of the correct positive yarn feed device. At the end of knitting a course, the yarn carrier is dropped off by the carriage, and this action stops the operation of the corresponding positive yarn feed device.

The invention claimed is:

1. A knitting machine comprising:

at least one knitting needle;

at least one positive yarn feed device for feeding yarn to said at least one knitting needle;

needle monitoring means for providing needle selection data relating to the at least one knitting needle during the course of a knitting operation; and a controller for controlling the operation of the positive yarn feed device;

in which the controller is adapted to: receive information from the needle monitoring means during the course of a knitting operation; use said information to calculate a desired amount of yarn to be fed to a knitting needle; and control the positive yarn feed device so that the positive yarn feed device feeds the desired amount of yarn to the knitting needle during the course of the knitting operation.

2. A knitting machine according to claim 1 in which the positive yarn feed device comprises a servomotor which is controlled by the controller.

3. A knitting machine according to 1 further comprising at least one stitch cam, in which the operation of the stitch cam is controlled by the controller during the course of a knitting operation.

4. A knitting machine according to claim 3 in which the stitch cam comprises a stitch cam motor for varying the position of said stitch cam, and the operation of the stitch cam motor is controlled by the controller during the course of a knitting operation.

5. A knitting machine according to claim 4 in which the stitch cam motor comprises a stepper motor.

6. A knitting machine according to claim 4 in which the stitch cam motor comprises a servomotor.

7. A knitting machine according to claim 3 in which the controller controls the operation of the stitch cam so as to produce knitted loops of a predetermined stitch length.

8. A knitting machine comprising at least one knitting needle; at least one positive yarn feed device for feeding yarn to said at least one knitting needle; needle monitoring means for providing information relating to the at least one knitting needle during the course of a knitting operation; a controller for controlling the operation of the positive yarn feed device; and fabric take down means, in which the operation of the fabric take down means is controlled by the controller during the course of a knitting operation, the controller receiving data from the needle monitoring means during the course of a knitting operation, using said data to calculate a desired amount of yarn to be fed to a knitting needle; and controlling the positive yarn feed device to feed the desired amount of yarn to the knitting needle during the course of the knitting operation.

9. A knitting machine according to claim 8 in which the fabric take down means comprises a fabric take down motor, and the operation of the fabric take down motor is controlled by the controller during the course of a knitting operation.

10. A knitting machine according to claim 9 in which the fabric take down motor comprises a servomotor.

11. A knitting machine according to claim 8 in which the controller controls the operation of the fabric take down means in accordance with the stitch length employed by the knitting machine.

12. A knitting machine comprising at least one knitting needle; at least one positive yarn feed device for feeding yarn to said at least one knitting needle; needle monitoring means for providing information relating to the at least one knitting needle during the course of a knitting operation; a controller for controlling the operation of the positive yarn feed device; and tension measuring means for measuring the tension of yarn fed to the at least one knitting needle, and the controller receiving data from the needle monitoring means during the course of a knitting operation, using said data to calculate a desired amount of yarn to be fed to a knitting needle; and controlling the positive yarn feed device to feed the desired amount of yarn to the knitting needle during the course of the knitting operation in which the yarn tension measured by the tension measuring means is communicated to the controller, and the controller utilises the measured yarn tension to control the knitting operation.

13. A knitting machine according to claim 12 in which the controller controls the operation of the stitch cam in accordance with the yarn tension measured by the tension measuring means.

14. A knitting machine comprising at least one knitting needle; at least one positive yarn feed device for feeding yarn to said at least one knitting needle; needle monitoring means for providing information relating to the at least one knitting needle during the course of a knitting operation; a controller for controlling the operation of the positive yarn feed device; and fabric take down means, in which the operation of the fabric take down means is controlled by the controller during the course of a knitting operation, and the controller receiving data from the needle monitoring means during the course of a knitting operation, using said data to calculate a desired amount of yarn to be fed to a knitting needle; and controlling the positive yarn feed device to feed the desired amount of yarn to the knitting needle during the course of the knitting operation, in which the controller controls the operation of the fabric take down means in accordance with the yarn tension measured by the tension measuring means tension measuring means for measuring the tension of yarn fed to the at least one knitting needle.

15. A flat-bed knitting machine according to claim 1.

16. A method comprising the steps of:

knitting a knitted structure with at least one yarn whilst supplying an amount of said yarn to at least one knitting needle using at least one positive yarn feed device;

maintaining operation of said at least one needle and providing needle selection data during the course of the knitting;

using said needle selection data to calculate a desired amount of yarn to be fed to a knitting needle; and controlling the positive yarn feed device so that said device feeds the desired amount of yarn to the knitting needle during the course of the knitting.

17. A method according to claim 16 further comprising the step of controlling the operation of a stitch cam during the course of the knitting.

18. A method according to claim 17 in which the step of controlling the operation of the stitch cam comprises controlling the operation of a stitch cam motor, which stitch cam motor varies the position of said stitch cam.

19. A method according to claim 17 in which the operation of the stitch cam is controlled so as to produce knitted loops of predetermined characteristics, preferably a predetermined stitch length.

20. A method according to 16 further comprising the step of controlling the operation of fabric take down means during the course of the knitting.

21. A method according to claim 20 in which the step of controlling the fabric take down means comprises controlling the operation of a fabric take down motor.

22. A method according to claim 20 in which the operation of the fabric take down means is controlled in accordance with the stitch length employed during the knitting.

23. A method according to claim 16 further comprising the step of measuring the tension of yarn fed to the at least one knitting needle, in which the measured yarn tension is utilised to control the knitting.

24. A method according to claim 23 in which the operation of the stitch cam is controlled in accordance with the measured yarn tension.

25. A method according to claim 23 in which the operation of the fabric take down means is controlled in accordance with the measured yarn tension.

26. A method of knitting according to claim 16 in which knitting is performed on a flat bed knitting machine.

27. A method according to claim 16 in which the stitch length is varied.

* * * * *